United States Patent [19]

Castonguay et al.

[11] Patent Number: 5,027,092

[45] Date of Patent: Jun. 25, 1991

[54] TRIPPING ARRANGEMENT FOR MOLDED CASE CIRCUIT INTERRUPTER

[75] Inventors: Roger N. Castonguay, Terryville; Thomas F. Papallo, Jr., Plainville, both of Conn.

[73] Assignee: General Electric Company, New York, N.Y.

[21] Appl. No.: 518,673

[22] Filed: May 3, 1990

[51] Int. Cl.[5] ..... H01H 9/00

[52] U.S. Cl. ..... 335/172; 335/21; 335/167

[58] Field of Search ..... 335/167-174, 335/21-23

[56] References Cited

U.S. PATENT DOCUMENTS 4,344,054 8/1982 Castonguay et al. ..... 335/172

*Primary Examiner*—Leo P. Picard
*Assistant Examiner*—Lincoln Donovan
*Attorney, Agent, or Firm*—Richard A. Menelly; Walter C. Bernkopf; Fred Jacob

[57] ABSTRACT

An integrated protection unit is a circuit breaker which includes basic overcurrent protection facility along with selective electrical accessories. A molded plastic accessory access cover secured to the integrated protection unit cover protects the accessory components contained within the integrated protection unit cover from the environment. A combined overcurrent trip actuator and multiple accessory unit can be field-installed within the integrated protection unit. The combined actuator-accessory unit includes electronic control circuitry for the accessories along with supplemental trip and reset interface components. The reset mechanism allows the actuator-accessory unit to become reset without interfering with the operation of the integrated protection unit. The trip interface components allow the circuit interrupter to interrupt a protected circuit by operation of the actuator-accessory unit.

11 Claims, 7 Drawing Sheets

TRIPPING ARRANGEMENT FOR MOLDED CASE CIRCUIT INTERRUPTER

BACKGROUND OF THE INVENTION

The trend in the circuit protection industry is currently toward complete circuit protection which is accomplished by the addition of supplemental protection apparatus to standard overcurrent protective devices, such as molded case circuit breakers. In the past, when such auxiliary protection apparatus or other circuit breaker accessories were combined with a standard circuit breaker, the accessories were usually custom-installed at the point of manufacture. The combined protective device, when later installed in the field, could not be externally accessed for inspection, replacement or repair without destroying the integrity of the circuit breaker interior. U.S. Pat. No. 4,894,631 describes a molded case circuit breaker containing an actuator-accessory unit which provides a wide variety of circuit protection accessory options. This patent is incorporated herein for purposes of reference and should be reviewed for its description of the state-of-the-art of such circuit breakers and accessory devices.

U.S. Pat. No. 4,913,503 describes a reset mechanism for a lower ampere-rated circuit interrupter usually employed as a "branch" circuit interrupter within industrial power distribution systems downstream from a higher-rated "main" circuit interrupter. When electronic trip units are used within the higher-rated circuits, a "flux shifter" tripping device is used to articulate the interrupter operating mechanism upon overcurrent conditions. One such flux shifter device is described within U.S. Pat. No. 4,641,117 which Patent is incorporated herein for purposes of reference. With the heavier operating mechanism springs used within higher-rated circuit interrupters, the actuator-accessory unit, per se, is incapable of generating sufficient tripping force to articulate the operating mechanism, such that additional tripping force is required. The additional tripping force is provided by a supplemental tripping mechanism which interacts with the actuator-accessory unit through a sequential resetting arrangement to insure that the actuator-accessory unit becomes reset before the main operating mechanism is reset. The operation of the sequential latching arrangement is described within U.S. patent application Ser. No. 518,672 filed May 3, 1990 entitled "Actuator-Accessory Reset Arrangement for Molded Case Interrupter or Electric Switch" which Application is incorporated herein for purposes of reference.

One purpose of this invention is to describe the supplemental tripping mechanism and its interaction with the sequential latching arrangement to interrupt circuit current by direct operation of the actuator-accessory unit.

SUMMARY OF THE INVENTION

An integrated protection unit which includes overcurrent protection along with auxiliary accessory function within a common enclosure contains an accessory cover for access to the selected accessory components to allow field installation of the accessory components. A combined actuator-accessory unit provides overcurrent, shunt trip or undervoltage release functions and is arranged within one part of the enclosure. The circuit interrupter operating mechanism interfaces with a sequential resetting arrangement by means of a sequence drive lever rotatably connected with the operating mechanism cradle. A supplemental tripping arrangement cooperates with the actuator-accessory unit to articulate the operating mechanism by operation of the actuator-accessory unit, per se.

DESCRIPTION OF THE PREFERRED EMBODIMENT

Figure 1:
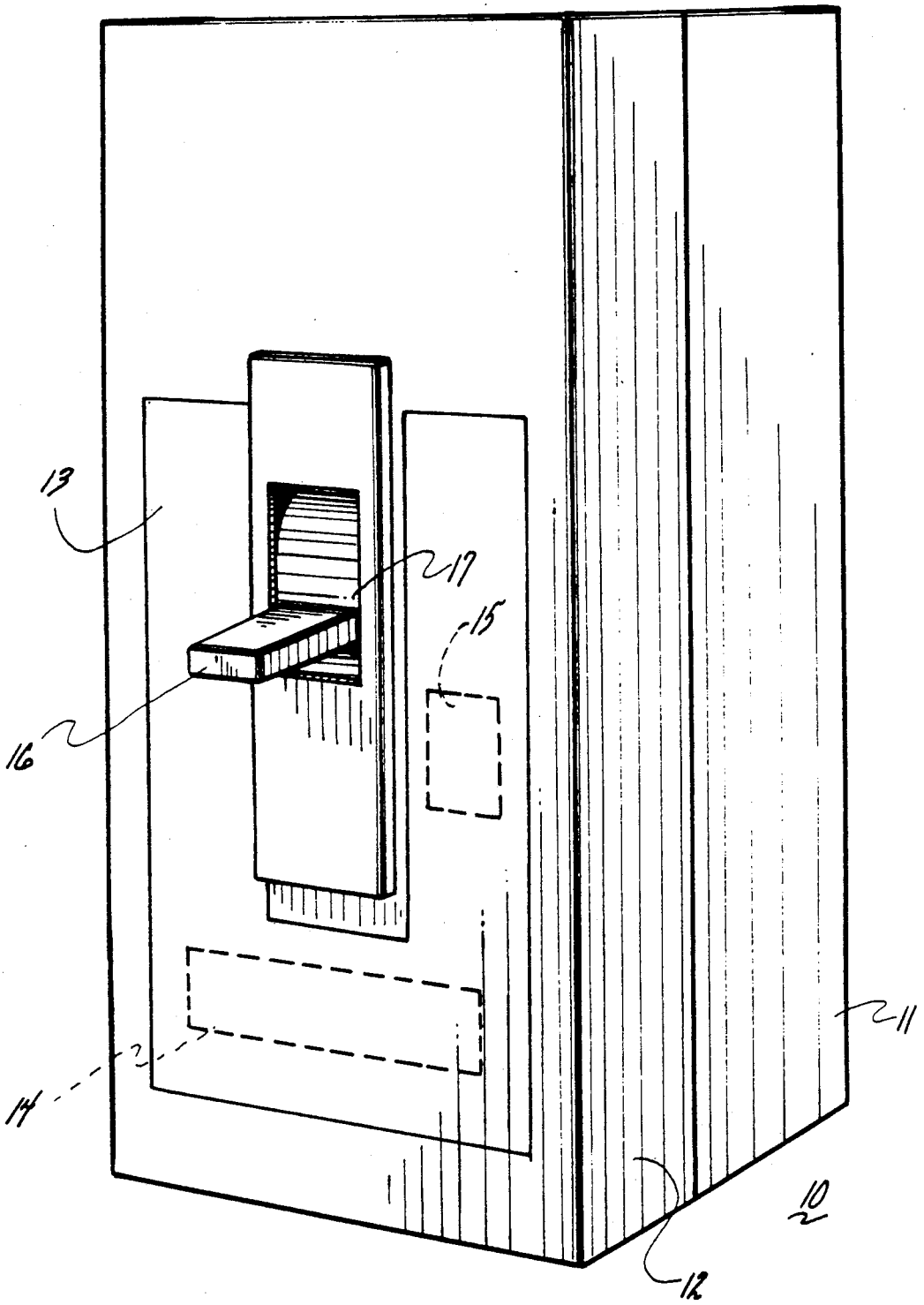
FIG. 1 is a top perspective view of a molded case circuit interrupter containing the supplemental tripping system in accordance with the invention.

A higher-rated circuit interrupter 10, as described earlier, is depicted in FIG. 1 and consists of a molded plastic case 11 to which a molded plastic cover 12 is fixedly secured. An accessory cover 13 is attached to the circuit interrupter cover and provides access to an electronic trip unit 14 and an actuator-accessory unit 15. An operating handle 16 extends through the circuit interrupter cover by means of an access slot 17 and provides manual intervention to turn the circuit interrupter contacts 19, 20 between their open and closed positions as best seen by referring now to the followings FIGS. 2–4A.

Figure 2:
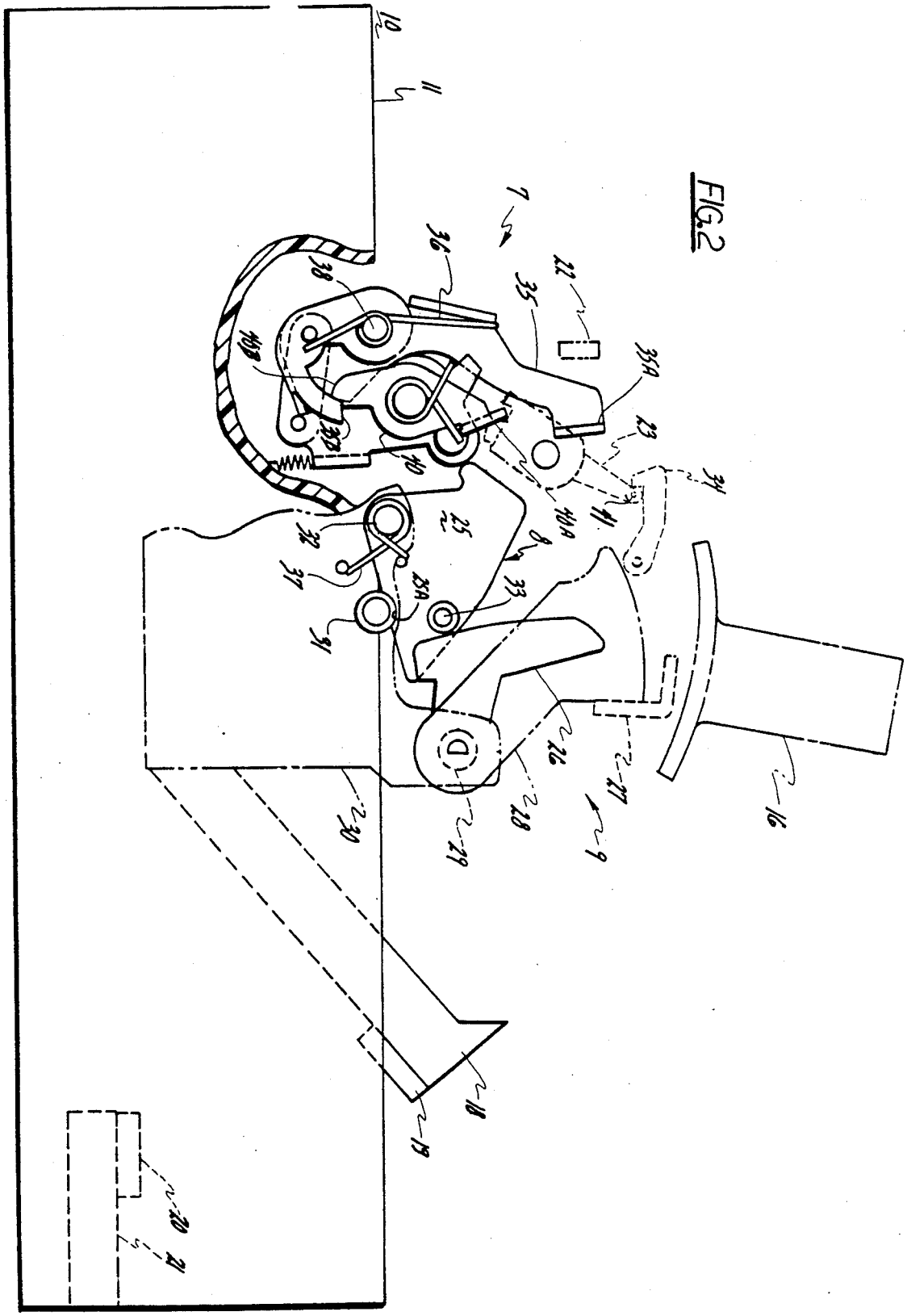
FIG. 2 is a cutaway side view of the circuit interrupter of FIG. 1 with the operating mechanism in a "TRIPPED" condition.
Figure 2A:
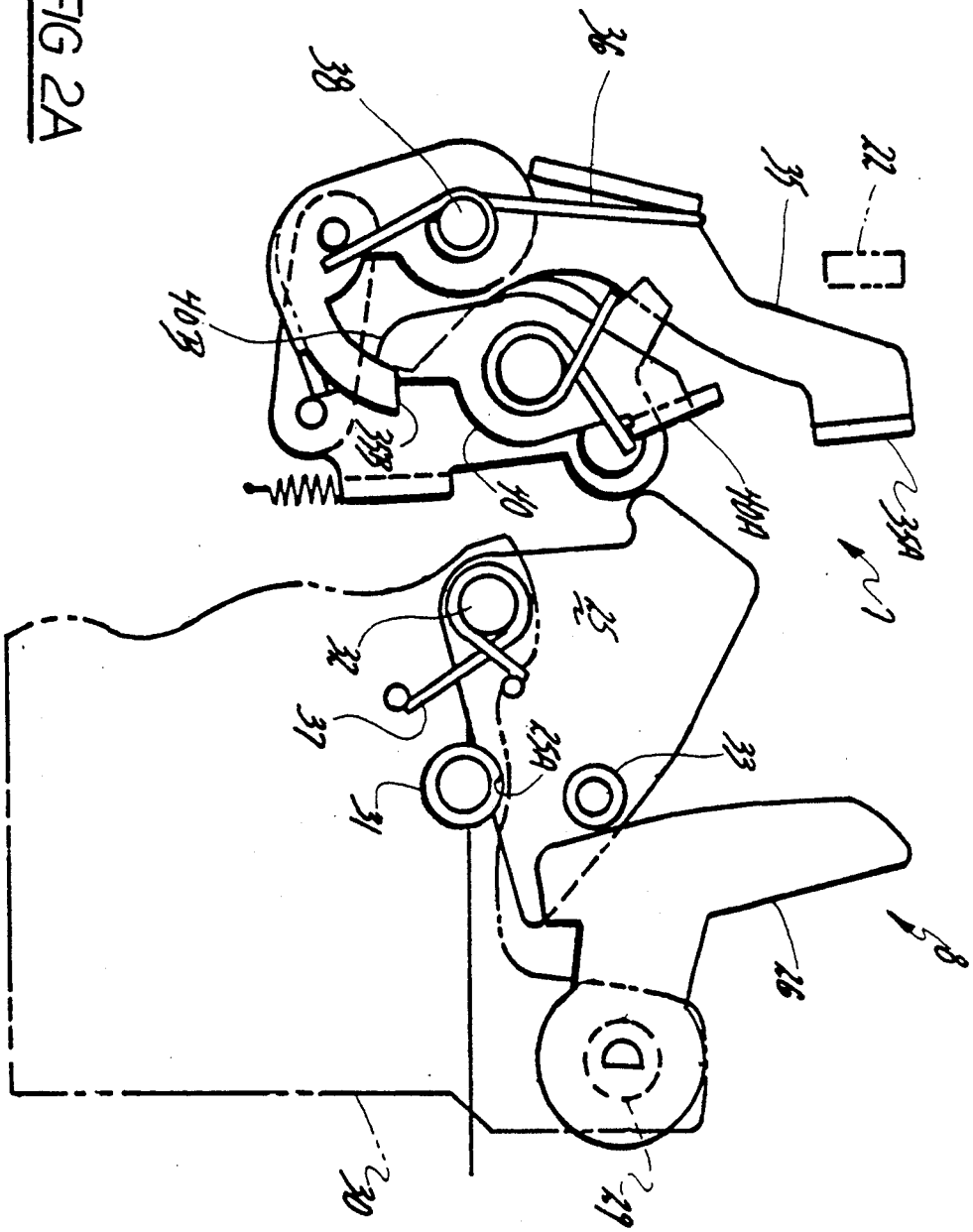
FIG. 2A is an enlarged side view of the tripping system shown in FIG. 2.

The contacts 19, 20 within the case 11 of the circuit interrupter 10 are depicted in the "TRIPPED" position of the circuit interrupter operating mechanism generally designated at 9 and which includes a cradle 28 for latching the movable contact arm 18 between its "CLOSED" and "OPEN" positions. In the TRIPPED position indicated in FIGS. 2, 2A, the movable contact arm 18 and attached movable contact 19 are automatically driven away from the fixed contact 20 and fixed contact support 21 by articulation of the operating mechanism upon the occurrence of an overcurrent condition, by means of the electronic trip unit. A good description of one such electronic trip unit is found within U.S. Pat. No. 4,658,323 while a general description of a circuit breaker operating mechanism is found within U.S. Pat. No. 4,736,174 both Patents are incorporated herein for purposes of reference. A combined actuator-accessory module for interfacing between the operating mechanism and the electronic trip unit is described in U.S. Pat. No. 833,563 which Patent is also incorporated herein for reference purposes. The operating handle 16, cradle 28 and operating mechanism sideframe 30 are depicted in phantom for purposes of clarity. The cradle 28 is operatively attached to the mechanism sideframe by means of a cradle pivot pin 29 such as described in U.S. Pat. Nos. 4,679,016 and 4,698,903 which Patents are incorporated herein for reference purposes. In returning the circuit breaker operating mechanism and contacts to their operable CLOSED positions, the actuator-accessory latch 34 and trip cam 23 associated with the actuator-accessory unit 15 within the circuit breaker cover 12 shown earlier in FIG. 1, are depicted herein in phantom in order to show the interaction between the circuit breaker operating mechanism 9, the sequential resetting arrangement 8, and the supplemental tripping system 7 in accordance with the invention. The relationship between the circuit breaker operating mechanism and the sequential resetting system within the case 11 is controlled by means of a sequence driver 26 arranged on the end of the cradle pivot pin. As the operating handle 16 and handle yoke 27 are moved sequentially counterclockwise to rotate the cradle 28 and reset the circuit breaker operating mechanism, the sequence driver 26 interacts with the sequential resetting system 8 by striking the drive roller 33 on the sequence lever 25 which in turn rotates the sequence lever about a pivot pin 32 bringing the latch pin 41 on the trip cam 23 into engagement with the actuator-accessory latch 34 as described within aforementioned U.S. patent application Ser. No. 518,67. The sequence lever 25 is attached to the sideframe by means of the pivot pin 32 and is biased to a rest position by means of a torsion spring 37. An arcuate cut-out 25A on the sequence lever 25 abuts against a post 31 on the sideframe to accurately return the sequence lever to its initial reset position under the return bias of the torsion spring 37. The interaction between the trip bar 22, trip cam 23 and the actuator-accessory latch 34 during the reset function of a circuit interrupter operating mechanism is described within aforementioned U.S. Pat. No. 4,913,503.

In the event that the actuator-accessory unit remains de-energized, the actuator-accessory latch 34 is unable to retain the latch pin 41 on the trip cam 23 thereby causing the trip cam 23 to strike against the angled end 40A of the trip latch 40 which in turn rotates the opposite end 40B of the trip latch out of abutment with the arcuate end 35B of the trip link 35 to allow the opposite end 35A of the trip link to strike the trip bar 22 by rotation about its pivot pin 38 under the urgence of the powerful trip spring 36. In the event that the circuit breaker operating mechanism and the actuator-accessory unit are in their latched or reset conditions, and an event occurs which causes the actuator-accessory unit to become operational, the circuit breaker operating mechanism is tripped by direct operation of the actuator-accessory unit in that the actuator-accessory latch 34 releases the latch pin 41 to rotate the trip cam 23, trip latch 40 and trip link 35 in the manner just described.

Figure 3:
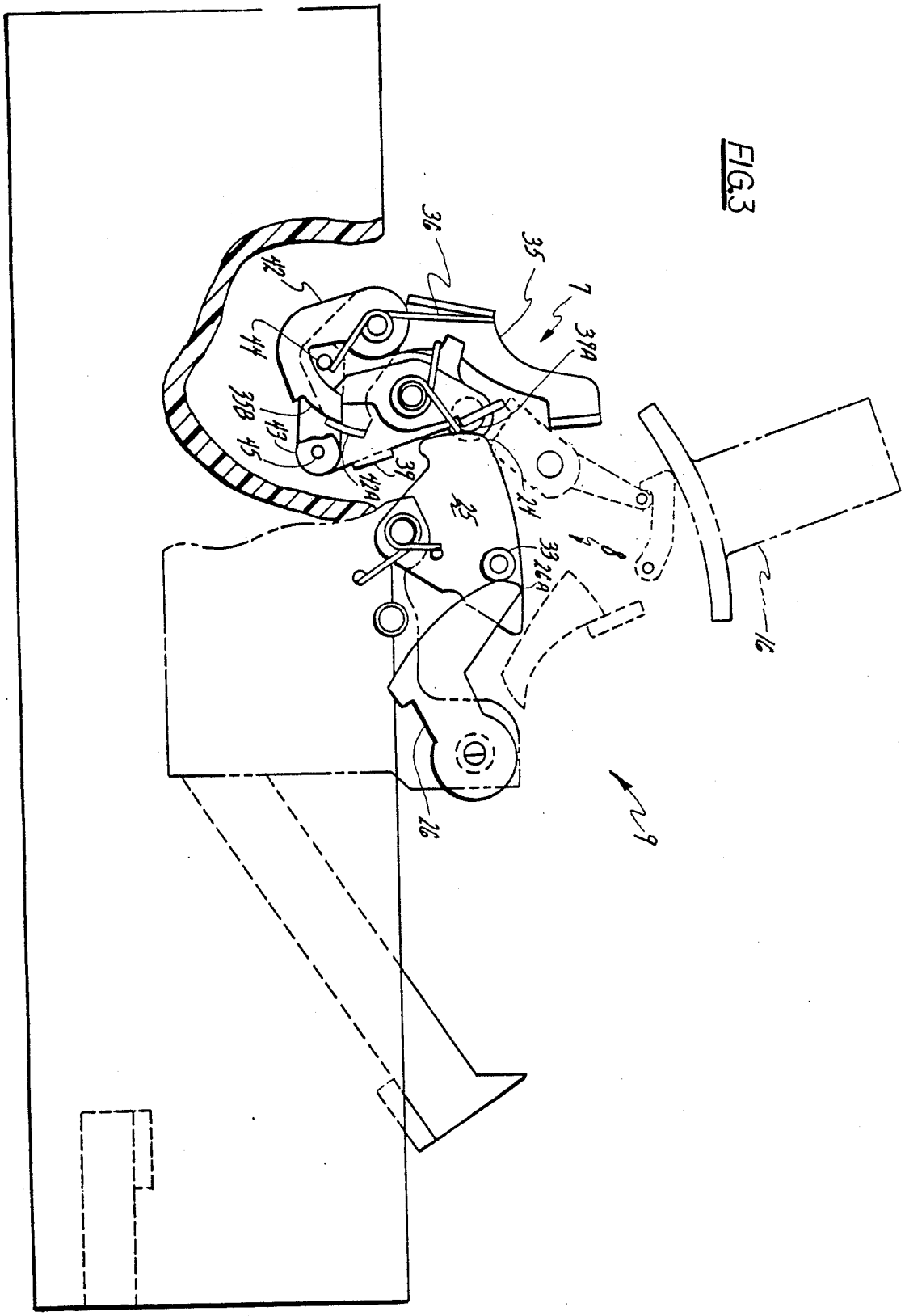
FIG. 3 is a cutaway side view of the circuit interrupter of FIG. 1 with the operating mechanism in a "LATCHED" condition.
Figure 3A:
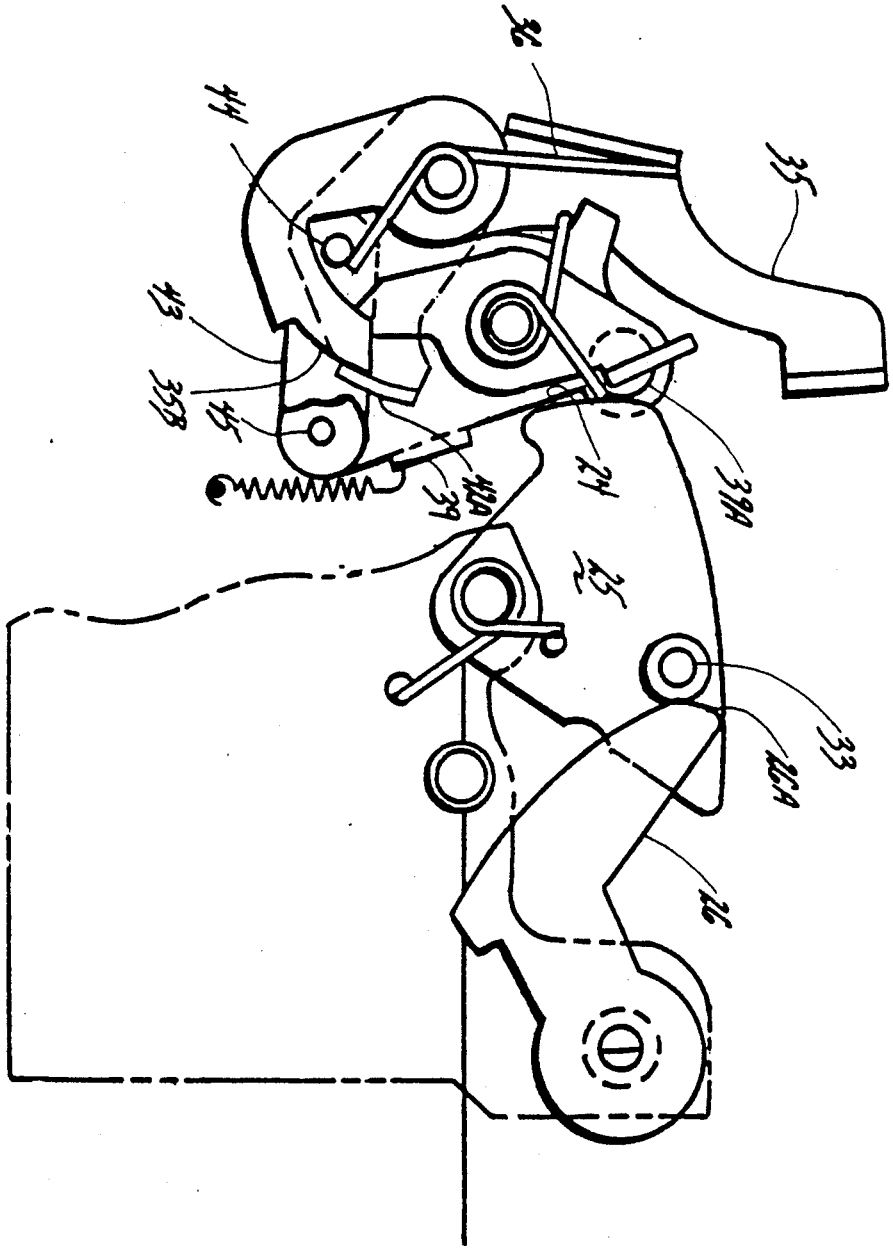
FIG. 3A is an enlarged side view of the tripping system show FIG. 3.

To reset the sequential reset system 8 and supplemental tripping system 7 before the main operating mechanism 9 can be reset, the operating handle 16 is moved counterclockwise to the position indicated in FIGS. 3, 3A which rotates the cam-shaped end 26A of the sequence driver 26 up against drive roller 33 on the sequence lever 25 and moves the cam-shaped end 24 of the sequence lever 25 against the pin 39A on the reset lever 39. This, in turn, rotates the reset lever 39 and reset driver 42 in the counterclockwise direction to charge the trip spring 36 to its fully charged position. The reset lever and reset driver move as a unit by the operative connection between the reset lever and reset driver by means of the reset link 43 and pins 44, 45. The trip spring 36 provides interference between the angled end 42A of the reset driver 42 and the end 35B of the trip link 35. This interference causes the reset driver and trip link to move as one unit.

Figure 4:
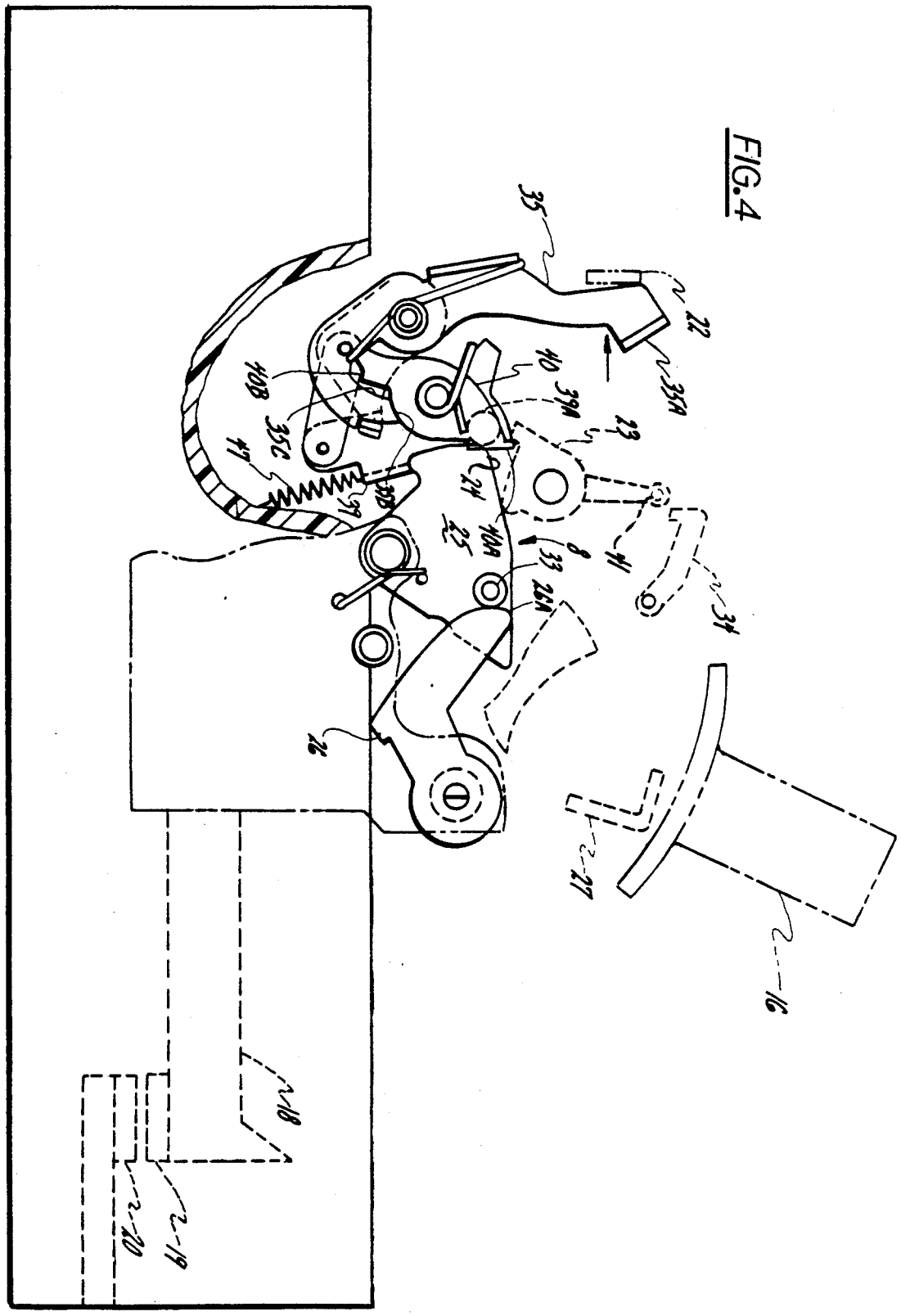
FIG. 4 is a cutaway side view of the circuit interrupter of FIG. 1 with the operating mechanism in a "CLOSED" condition.
Figure 4A:
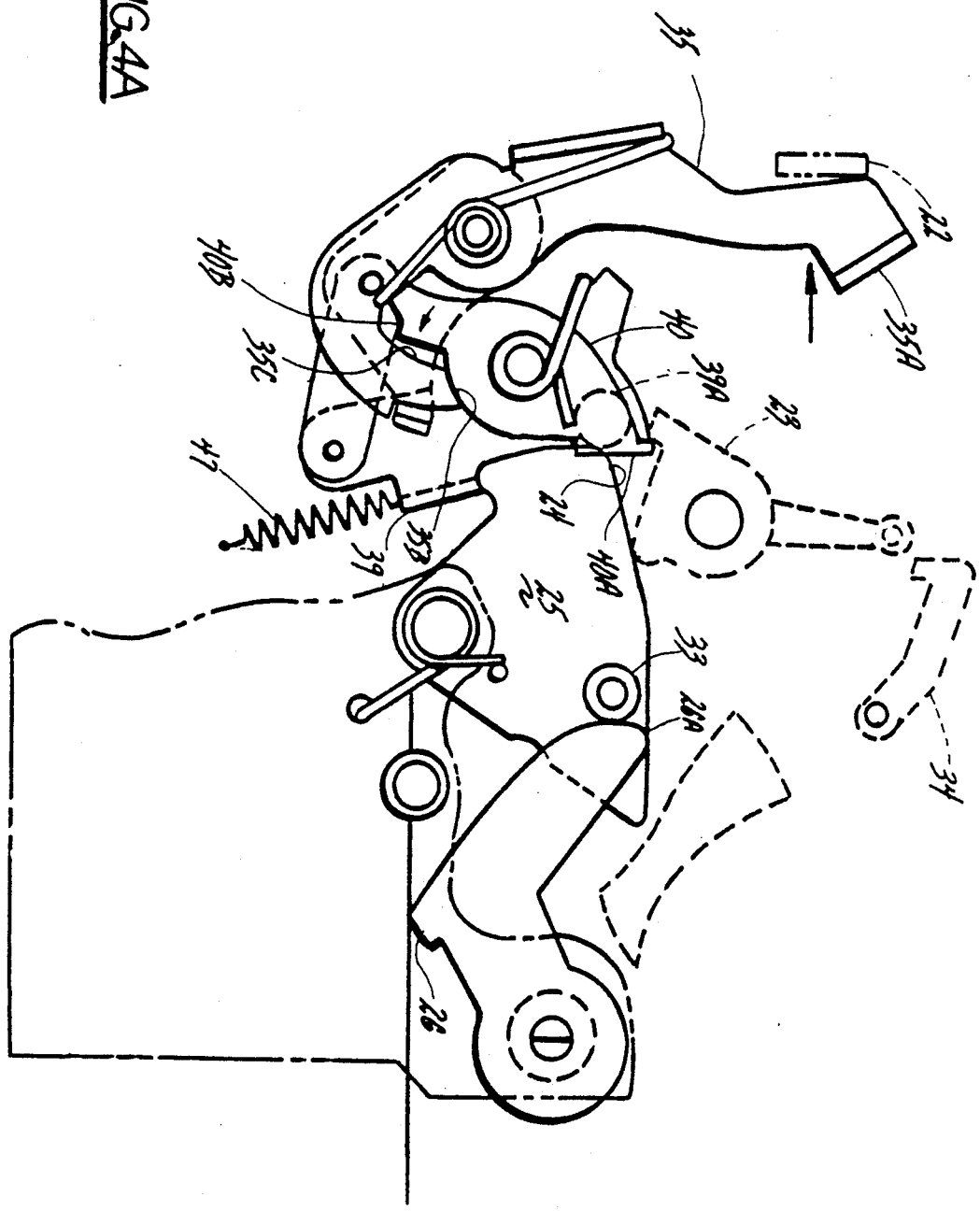
FIG. 4A is an enlarged side view of the tripping system shown in FIG. 4.

The circuit breaker operating mechanism is brought to its closed condition by movement of the operating handle 16 to the position shown in FIGS. 4, 4A whereby the handle yoke 27 has driven the movable contact arm 18 and attached movable contact 19 into abutment with the fixed contact 20. The sequence driver 26 assumes the position shown in FIGS. 4, 4A with the cam-shaped end 26A of the sequence driver 26 against the drive roller 33 and with the cam-shaped end 24 of the sequence lever 25 abutting against the pin 39A on the reset lever 39. The actuator-accessory latch 34 retains the trip cam 23 by means of the latch pin 41. When the actuator-accessory unit is energized to trip the circuit breaker operating mechanism, the actuator latch 34 rotates in a clockwise direction to release the latch pin 41 and thereby allow the trip cam 23 to move the angled end 40A of the trip latch 40 thereby allowing the trip latch to rotate in a clockwise direction and release the end 35B of the trip link 35 from contact with the end 40B of the trip latch 40 and allow the opposite end 35A of the trip link 35 to strike the trip bar 22 and propel the trip bar in the indicated direction to release the circuit breaker operating mechanism. The arcuate shape of the trip link 35 depicted at 35C allows the end 40B of the trip latch 40 to rotate clockwise away from the end 35B of the trip link without interfering with the rotation of the trip link in the counterclockwise direction. The reset lever spring 47 allows the reset lever 39 and trip link 35 to rotate as a unit back to the reset position indicated earlier in FIG. 2.

The supplemental tripping mechanism is also employed with circuit interrupters utilizing an accessory unit, per se in the circuit interrupter cover in place of an actuator unit or combined actuator-accessory unit to articulate the circuit breaker operating mechanism. An undervoltage release accessory unit is one type of an accessory unit that could be used with the supplemental tripping mechanism in accordance with the invention. One such undervoltage release accessory unit is described within U.S. Pat. No. 4,801,907.

Having thus described our invention, what we claim as new and desire to secure by Letters Patent is:

1. A molded case circuit interrupter comprising:

a molded plastic case and cover;

an actuator unit or accessory unit within said cover;

an electronic trip unit within said cover for determining overcurrent conditions through a protected circuit;

an operating mechanism contained between a pair of opposing sideframes within said case and arranged for separating a pair of contacts upon operation of said electronic trip unit;

an externally accessible operating handle connecting with said operating mechanism through a handle yoke arrangement for moving said operating mechanism between closed and open positions;

a tripping system within said case intermediate said actuator unit or accessory unit and said operating mechanism for articulating said operating mechanism upon operation of said actuator unit or accessory unit, said tripping system including a trip link pivotally arranged within said case proximate a trip bar operatively associated with said operating mechanism and a reset driver connected to said trip link by means of a common pivot;

a trip latch pivotally arranged within said case proximate said trip link; and a reset lever pivotally arranged within said case on a common pivot with said trip latch intermediate said trip link and said operating mechanism, said reset lever being attached to said trip link and said reset driver by means of a reset link whereby rotation of said reset lever causes corresponding rotation of said trip link and said reset driver, one end of said trip latch interferes with one end of said trip link to retain said trip link against rotation bias provided by a trip link spring.

2. The circuit interrupter of claim 1 wherein said actuator unit includes an actuator latch, a latch pin and a trip cam, said trip cam being restrained from contacting said one end of said trip latch by retention of said latch pin by said actuator latch.

3. The circuit interrupter of claim 1 wherein said one end of said trip link adjoins an arcuate arm on said trip link providing clearance of said other end of said trip latch to thereby allow said trip latch to rotate away from said trip link when said other end of said trip link is free to rotate into contact with said trip bar to articulate said operating mechanism.

4. The circuit interrupter of claim 3 including a drive lever operatively connected to said operating mechanism and arranged for rotating commonly with said operating mechanism.

5. The circuit interrupter of claim 4 including a sequence lever pivotally attached to one of said sideframes and biased against a stop pin to a rest position when said operating mechanism is in a closed position.

6. The operating mechanism of claim 5 including a drive roller on said sequence lever and arranged for receiving said drive lever and rotating said sequence lever when said operating mechanism is rotated from a tripped to a reset position.

7. The circuit interrupter of claim 6 wherein said sequence lever strikes said reset lever causing said reset lever, said reset link, said reset driver and said trip link to rotate in turn as a single unit when said operating mechanism is rotated from said tripped to said reset condition.

8. The circuit interrupter of claim 7 wherein said trip link is attached to a supplemental support in said case by a pivot and a torsion spring is arranged around said pivot to bias said trip link to a tripping position.

9. The circuit interrupter of claim 2 including a drive roller on said sequence lever abutting said sequence driver.

10. The circuit interrupter of claim 4 wherein said drive lever comprise an L-shaped configuration having a first part and a second part, said first part abutting said drive roller and said second part being attached to said operating mechanism.

11. The circuit interrupter of claim 2 wherein said trip cam is pivotally arranged within said cover by means of a pivot pin.

* * * * *